United States Patent [19]

Watkins

[11] Patent Number: 4,839,930

[45] Date of Patent: Jun. 20, 1989

[54] DRY HYDRO-MASSAGE UNIT FOR A SPA TANK

[75] Inventor: Jonathan Watkins, Vista, Calif.

[73] Assignee: Watkins Manufacturing Corporation, Carlsbad, Calif.

[21] Appl. No.: 199,971

[22] Filed: May 27, 1988

[51] Int. Cl.[4] ..... A61H 37/00

[52] U.S. Cl. ..... 4/546; 4/542; 4/559; 4/575; 128/64; 128/66

[58] Field of Search ..... 128/66, 65, 64, 37, 128/39; 4/541, 542, 543, 544, 546, 547, 548, 549, 551, 559, 575, 661, 555

[56] References Cited

U.S. PATENT DOCUMENTS

| | | | |
|---|---|---|---|
| 992,905 | 5/1911 | Robinson | 4/615 |
| 1,780,876 | 11/1930 | Grosse | 128/64 |
| 2,200,247 | 5/1940 | Haas | 4/575 |
| 2,591,252 | 4/1952 | Gilson | 4/542 |
| 2,646,039 | 7/1953 | Agosti | 128/64 |
| 3,273,560 | 9/1966 | Jacuzzi | 128/66 |
| 3,297,025 | 1/1967 | Jacuzzi | 128/66 |
| 3,302,640 | 2/1967 | Jacuzzi | 128/66 |
| 3,396,722 | 8/1968 | Lindberg, Jr. | 128/66 |
| 3,416,166 | 12/1968 | Hanson | 4/555 |
| 3,452,370 | 7/1969 | Jacuzzi | 128/66 |
| 3,483,862 | 12/1969 | Takeuchi | 128/64 |
| 3,540,438 | 11/1970 | Jacuzzi | 128/66 |
| 3,571,820 | 3/1972 | Jacuzzi | 4/542 |
| 3,674,020 | 7/1972 | Jacuzzi | 128/66 |
| 3,720,204 | 3/1973 | Wojtowicz | 128/64 |
| 3,736,924 | 6/1973 | Jacuzzi et al. | 128/66 |
| 3,768,462 | 10/1973 | Boulard | 128/44 |
| 3,806,964 | 4/1974 | Vanegas et al. | 4/542 |
| 3,820,173 | 6/1974 | Weller | 4/496 |
| 3,842,823 | 10/1974 | Jacuzzi et al. | 128/66 |
| 3,874,374 | 4/1975 | Jacuzzi | 4/542 |
| 3,905,358 | 9/1975 | Jacuzzi | 128/66 |
| 4,139,001 | 2/1979 | Macabee | 128/64 |
| 4,220,145 | 9/1980 | Stamp et al. | 128/66 |
| 4,313,432 | 2/1982 | Sievers | 128/37 |
| 4,335,854 | 6/1982 | Reynoso | 4/542 X |
| 4,339,833 | 7/1982 | Mandell | 4/542 |
| 4,389,740 | 6/1983 | Henry | 4/575 |
| 4,523,340 | 6/1985 | Watkins | 4/542 |
| 4,561,133 | 12/1985 | Laing | 4/491 |
| 4,575,882 | 3/1986 | Diamond | 4/559 |
| 4,607,405 | 8/1986 | Ellis et al. | 5/541 |
| 4,635,620 | 1/1987 | Ricchio | 128/64 |
| 4,665,572 | 5/1987 | Davidson et al. | 4/492 |
| 4,679,258 | 7/1987 | Henkin et al. | 4/542 |
| 4,692,950 | 9/1987 | Henkin et al. | 4/542 |
| 4,731,887 | 3/1988 | Henkin et al. | 4/541 |
| 4,776,046 | 10/1988 | Newberry et al. | 4/541 |
| 4,780,916 | 11/1988 | Sutton | 4/543 |

FOREIGN PATENT DOCUMENTS

| | | | |
|---|---|---|---|
| 0060206 | 3/1982 | European Pat. Off. | 128/64 |
| 561059 | 4/1975 | Switzerland | 128/66 |
| 262520 | 12/1926 | United Kingdom | 128/64 |
| 291922 | 6/1928 | United Kingdom | 128/64 |

*Primary Examiner*—Henry J. Recla
*Assistant Examiner*—Daniel D. Stein-Freer
*Attorney, Agent, or Firm*—Edgar A. Zarins; Malcolm L. Sutherland; Leon E. Redman

[57] ABSTRACT

A unit for use in a spa tub to provide a dry hydro-massage of the neck and shoulders. The unit includes a diaphragm which sealingly covers a discharge jet such that the fluid will flex the diaphragm into massaging relationship with the user's body. The water is exhausted into the spa through a secondary port below the water line such that dry hydro-therapy is provided by the unit. The unit is mounted within the side wall of the tub spa and can be telescopingly adjusted between a position just below the water line and a position above the water line. With the unit in the upper position the user may remain seated within the spa while the unit provides a dry hydro-massage of the neck and upper back normally positioned above the water line. Lower positions provide massage of lower body portions and facilitate storage and covering of the spa. The diaphragm unit is adapted to be utilized with various jet nozzles.

22 Claims, 4 Drawing Sheets

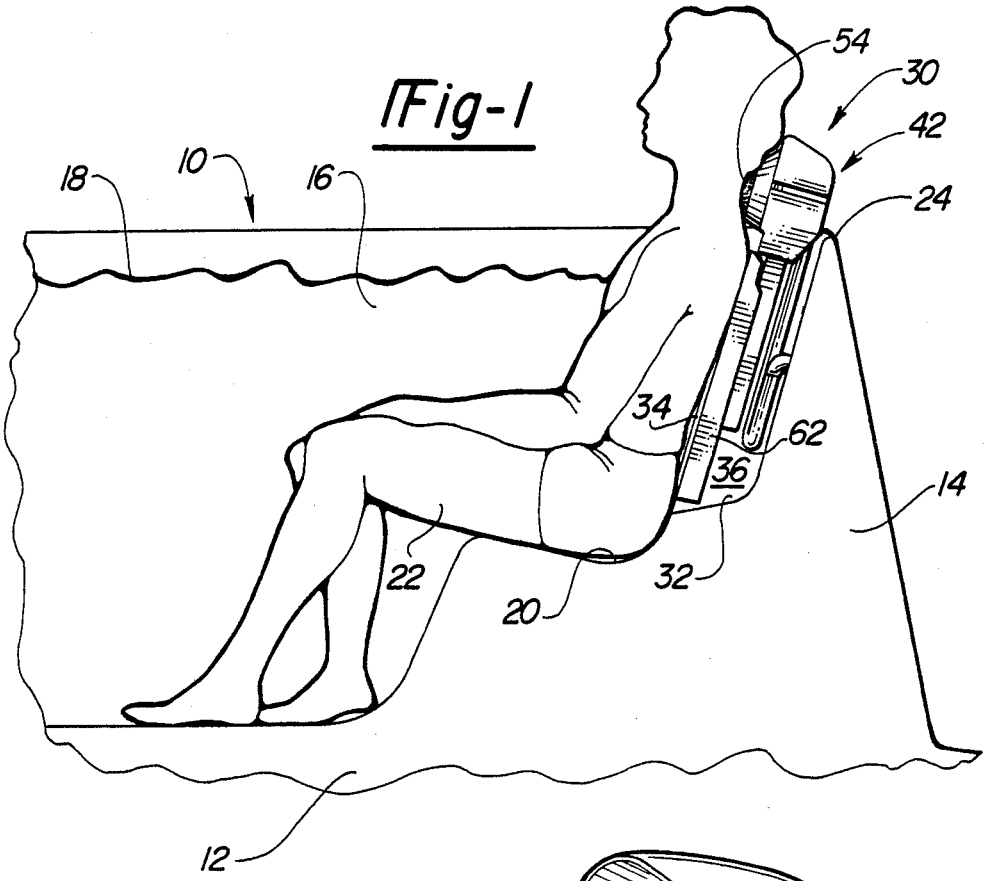
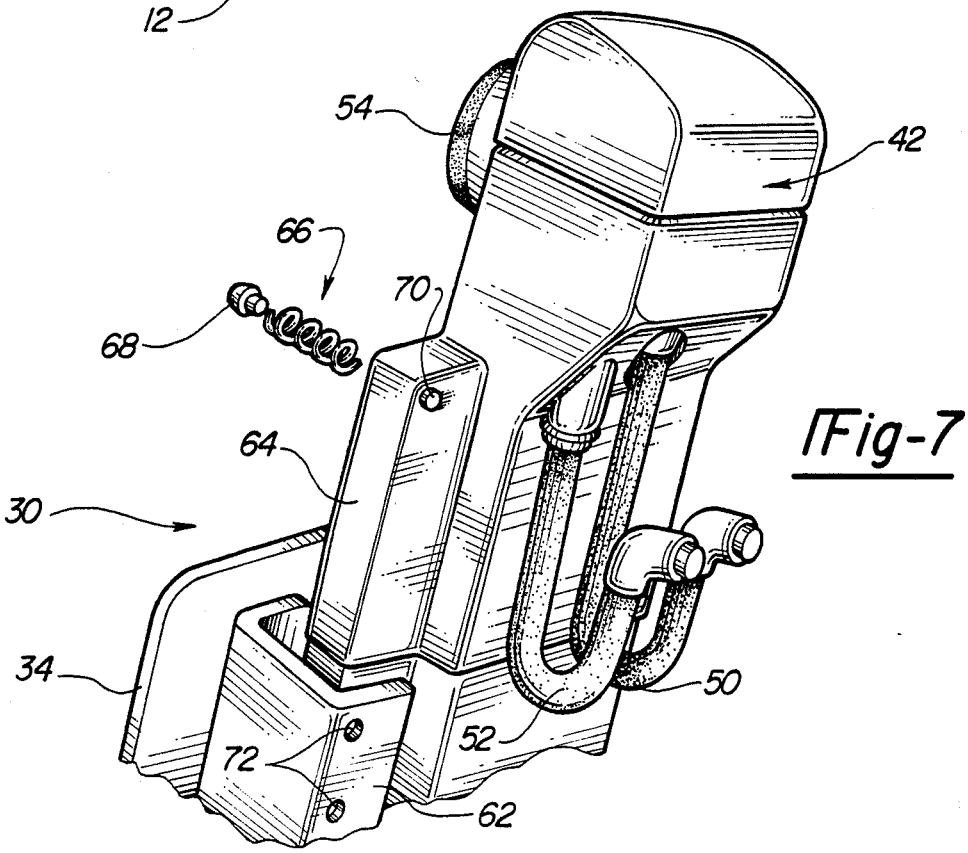
Fig-7

DRY HYDRO-MASSAGE UNIT FOR A SPA TANK

BACKGROUND OF THE INVENTION

I. Field of the Invention

This invention relates to a hydro-massage unit for a whirlpool spa or the like and, in particular, to a dry hydro-massage unit which is selectively telescopingly extended above the water line to provide a dry massage of upper body portions while the user is situated within the spa tub.

II. Description of the Prior Art

Hydrotherapy jet discharges for whirlpool tubs and spas have been developed to provide a turbulent mix of water and air for impacting against a user's body in the spa. These discharges have been refined to provide efficient flow with maximum therapeutic benefit. Discharge jets which are selectively directionally adjustable by the user and jets which travel along a closed path are well known embodiments for increasing the benefits of the spa. However, these discharge jets must be positioned below the water line within the spa to minimize splash. As a result, the therapeutic benefits are limited to the body parts below the water line or the user must slouch down in an attempt to apply the massaging effect to the shoulders.

Closed dry hydro-massage systems have been developed for specific devices such as automobile seats. These systems circulate the water from a closed reservoir against a membrane which engages the user. The membrane may form the back of a car seat or the upper surface of a waterbed mattress. However, such systems have not been employed in spas to provide hydromassage of selected body parts.

SUMMARY OF THE PRESENT INVENTION

The present invention overcomes the disadvantages of the prior known hydro-massage systems by providing a dry hydro-massage unit for a spa which is selectively adjustable between a lower position flush with the top surface of the spa and an upper position extending above the spa edge to massage the user's neck and shoulders normally disposed above the water line.

The dry hydro-massage unit according to the present invention generally comprises a housing having air and water supply means to supply the turbulent mixture to the discharge head. The discharge head is sealingly positioned behind a flexible diaphragm such that the discharge is directed against the diaphragm. The housing is provided with an air vent at the top to allow air to escape and a water exhaust at the bottom of the housing. The water exhaust fluidly communicates with the spa to permit escape of the water back into the spa. The housing is disposed within a side wall of the spa and is selectively adjustable between lower and upper positions. A slot formed in the side wall allows the housing to travel to the lower position substantially even with the water level in the spa. In the upper position, the housing extends well above the water line and above the top surface of the spa to provide a dry massage of the user's neck. In each of the selected positions, the discharge head forces the air/water mixture against the diaphragm and the water is exhausted into the spa through a port below the water line. In this manner, a dry hydromassage is provided to parts of the user's body disposed above the water line.

The present invention has the advantage of providing the therapeutic benefits of a hydro-massage to the neck and head area without the water splash of past known spa jets. As a result, water splash against the face and eyes is eliminated permitting the user to quietly enjoy the dry hydro-massage. The invention has the added benefit of keeping the user's hair and face dry thus allowing users with styled hairdos and makeup to enjoy the massaging benefits of the spa without ruining the hairdo or makeup.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which:

FIG. 1 is a side break-away view of the hydro-massage unit embodying the present invention in conjunction with a user seated within a spa tub;

FIG. 7 is an exploded view of the hydro-massage unit embodying the present invention.

DETAILED DESCRIPTION OF A PREFERRED EMBODIMENT OF THE PRESENT INVENTION

Figure 2:
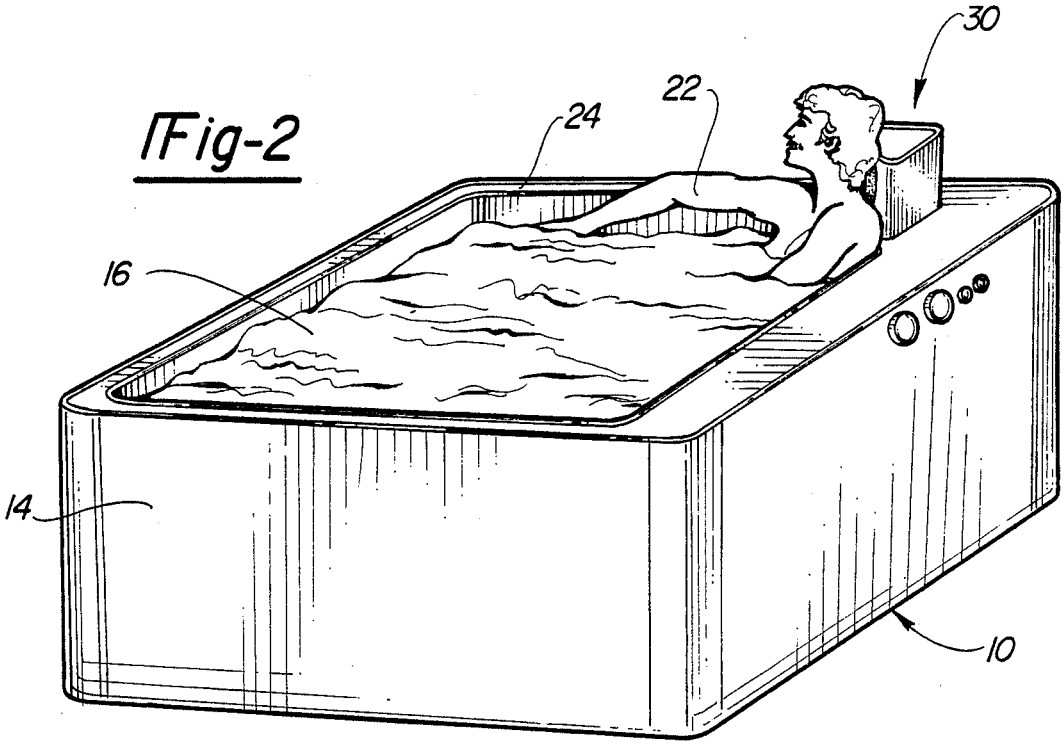
FIG. 2 is an elevational perspective of a user in a spa tub with the hydro-massage unit embodying the present invention.
Figure 3:
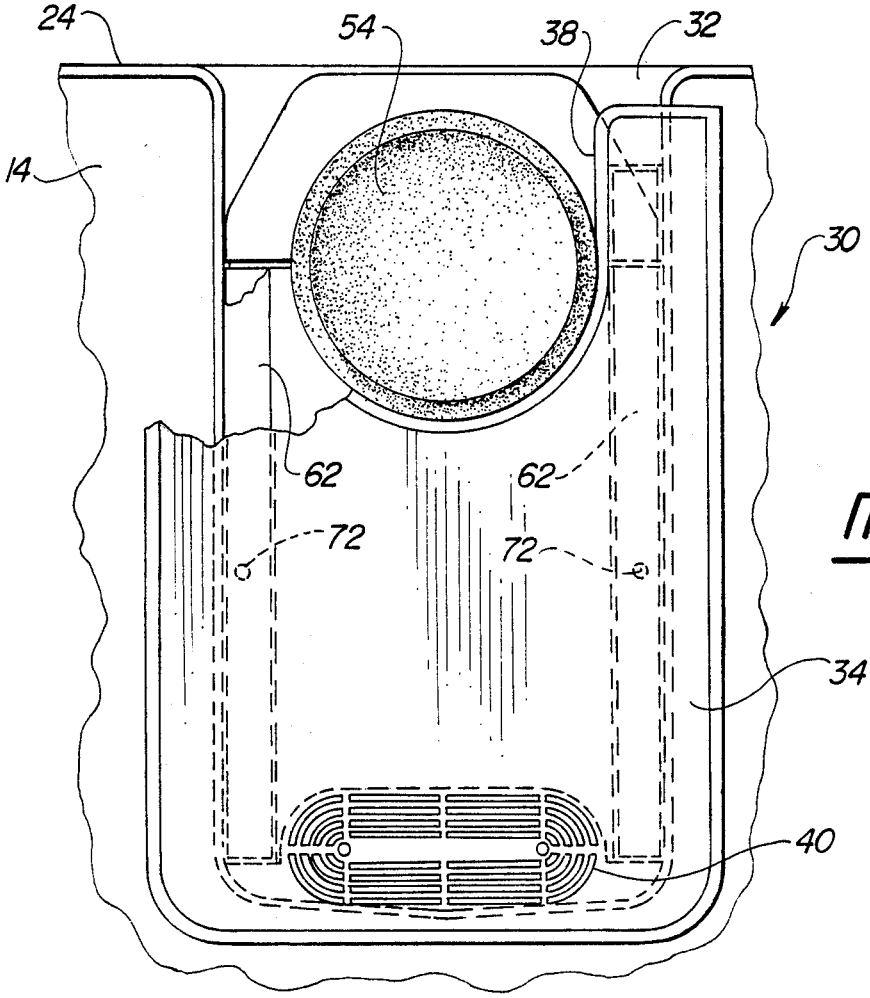
FIG. 3 is a front perspective of the hydro-massage unit of the present invention in its lower position.

Referring first to FIGS. 1 and 2 there is shown a spa tub 10 embodying a preferred embodiment of the present invention. The tub 10 generally comprises a bottom 12 and a peripheral wall 14 which form an interior basin adapted to retain water 16 at a desirable water level 18. The tub 10 may also include a seat or bench 20 upon which a user 22 may sit while maintaining their head above the water level 18. Generally, the water level 18 is maintained a predetermined distance below the top rim 24 of the tub !0.

Incorporated into the peripheral wall 14 of the tub 10 is a dry hydro-massage unit 30 embodying the present invention adapted to provide the soothing massage of hydro-therapy discharge jets without the fluid discharge of known hydrotherapy assemblies. As a result, the user 22 can provide hydro-massage of upper body parts such as the back of the neck or the top of the shoulders, body portions which are normally disposed above the water line 18, without the annoying splash and discharge of conventional discharge assemblies. The dry hydro-massage unit 30 may be positioned in a corner of the tub 10 as shown in FIG. 2 or along the side walls of the tub 10. In a preferred embodiment, the dry hydro-massage unit 30 is mounted within an opening 32 formed in the peripheral wall 14 of the tub 10. An enclosure plate or wall 34 is mounted substantially flush with the peripheral wall 14 over the opening 32 to form an interior chamber 36 open to the top of the tub 10. The dry hydro-massage unit 30 is disposed within the chamber 36. The enclosure wall 34 includes a U-shaped slot 38 which guidingly receives the discharge head of the unit 30 as will be subsequently described. An exhaust port 40 formed near the bottom of the enclosure wall 34 provides fluid communication between the interior chamber 36 and the interior basin of the tub 10. The water utilized by the hydromassage jet assembly is exhausted through the port 40 disposed well below the water line 18 thereby eliminating any splash as will be subsequently described in conjunction with the operation of the invention.

Referring now to FIGS. 4 through 7, the dry hydro-massaging unit 30 includes a hydro-massage jet assembly 42 having a discharge jet 44 which supplies the therapeutic turbulent mixture of air and water. The therapeutic mixture is supplied to the discharge jet 44 through a water pipe 46 and an air pipe 48 which are connected to the pumping supply through flexible hoses 50 and 52, respectively. The pumping supply draws water from the spa basin thereby creating a recirculating water supply. The discharge jet 44 is preferably in the nature of a venturi jet nozzle adapted to optimize the entrainment of the air into the water prior to discharge. The discharge jet 44 may have a reciprocating or circular motion within the head assembly to increase the benefits of the massage. A pulsating jet may also be utilized.

Figure 4:
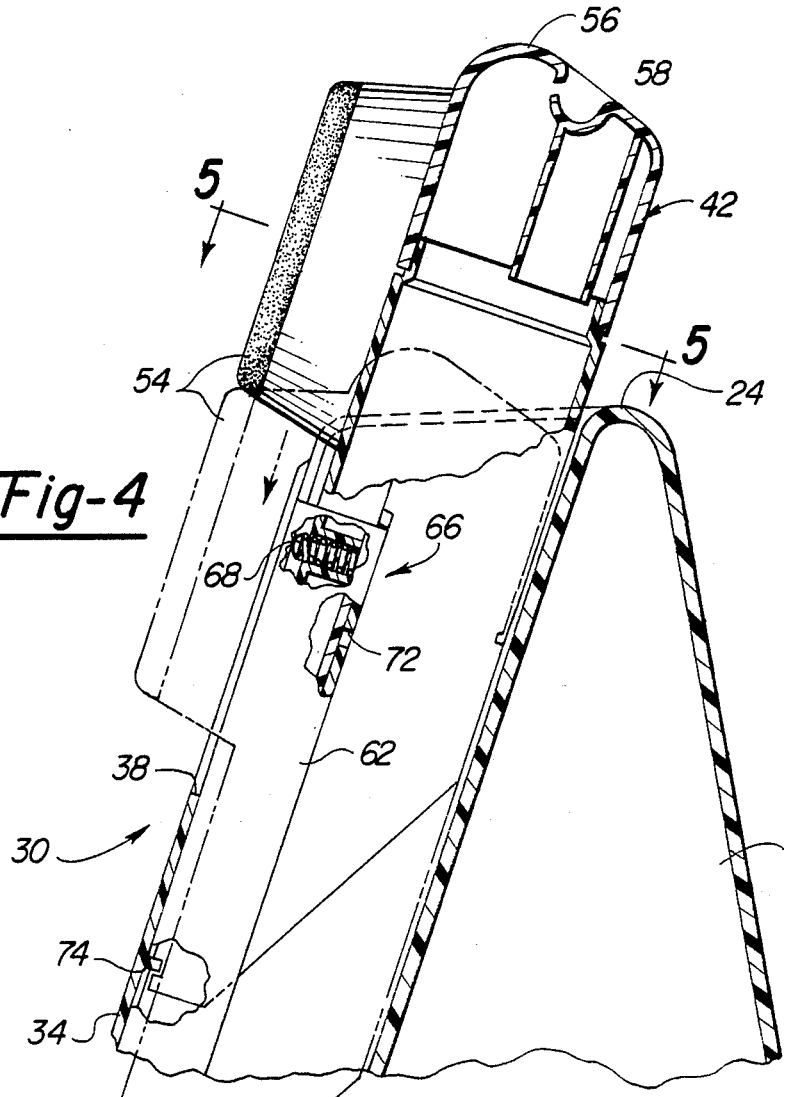
FIG. 4 is a cross-sectional perspective of the hydro-massage unit of the present invention.
Figure 5:
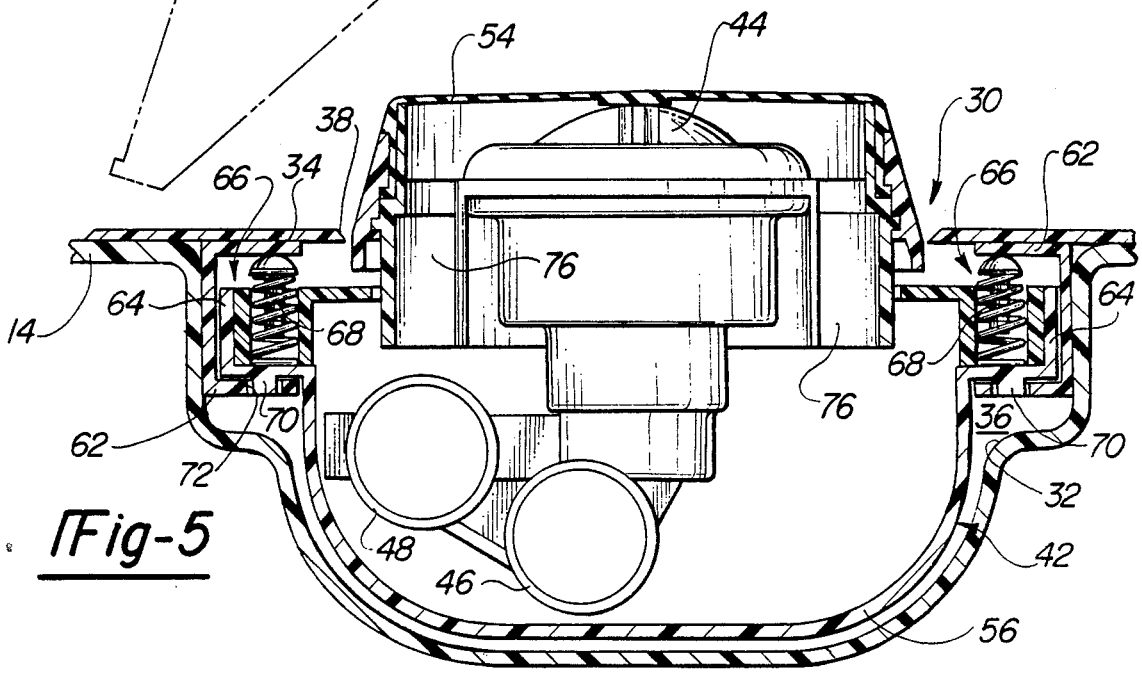
FIG. 5 is a cross-sectional perspective taken along line 5—5 of FIG. 4.

The discharge jet 44 is sealingly covered with a flexible diaphragm 54 which prevents the massaging fluid from being discharged from the hydro-massage jet assembly 42 onto the user 22. However, the flexible properties of the diaphragm 54 transmit the massaging motion to the body part positioned against the diaphragm 54. The massaging fluid which is discharged against the diaphragm 54 flows back into the housing 56 of the hydro-massage jet assembly 42 for appropriate exhaust. The housing 56 includes an air vent 58 formed in the top thereof for venting of the captured air and a water vent 60 for exhaust of the water. The air vent 58 may communicate with the exterior of the housing 56 to simply discharge the air as shown in FIG. 4. Alternatively, a vent **58*a* may be provided which communicates with the air supply pipe 48 to permit recirculation of air through the system. The water vent 60 communicates with the interior chamber 36 thereby allowing the water to flow back into the tub 10 through the exhaust port 40 well below the water line 18**. As a result, the water splash associated with prior known hydro-massage units is eliminated.

Figure 6:
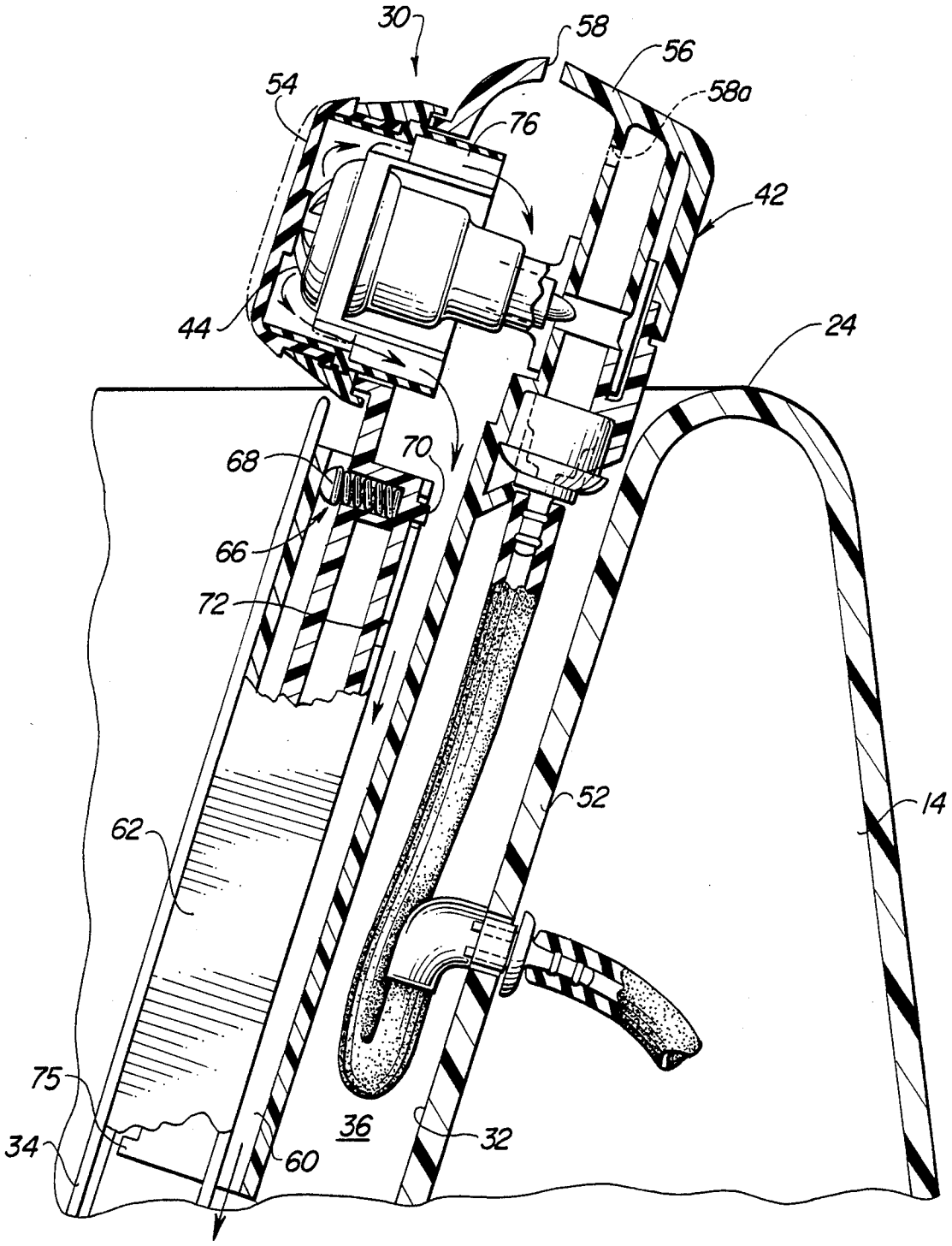
FIG. 6 is a cross-sectional perspective of the hydro-massage unit of the present invention in its extended position with the massaging fluid flowing therethrough.

The hydro-massage jet assembly 42 is telescopically mounted within the interior chamber 36 of the peripheral wall 14 for selective adjustment of the diaphragm covered discharge jet 44 between a first position substantially at or below the water line 18 through a second position above the top rim 24 of the tub 10 as shown in FIGS. 4 and 6. The hydro-massage jet assembly 42 is guided by a pair of tracks 62 preferably opposingly mounted to the interior side of the enclosure wall 34 on opposite sides of the slot 38. The tracks 62 may be molded to the enclosure wall 34 or attached thereto using conventional fastening means. As is shown in FIG. 7, the tracks 62 receive side portions 64 of the hydro-massage housing 56 which can include locking means 66 to positionally maintain the hydro-massage jet assembly 42 relative to the tracks 62 and the chamber 36. In a preferred embodiment, the locking means 66 includes a spring-biased pin 68 mounted within the side portions 64 which cooperate with the tracks 62 to bias the hydro-massage jet assembly 42 away from enclosure wall 34. The back of the side portions 64 are provided with an integral pin 70 which cooperates with a series of apertures 72 to positionally maintain the hydro-massage jet assembly 42 in a plurality of positions from the first lowermost position to the second uppermost position. The present invention is also provided with cooperating terminal stops 74 and 75 on the enclosure plate 34 and the jet assembly 42 to prevent the hydro-massage jet assembly 42 from being inadvertently removed from the chamber 36. Of course other means of positionally locking the jet assembly 42 in place will operate with the present invention to permit selective adjustment of the hydro-massage assembly.

Operation of the present invention allows selective positional adjustment of the hydromassage jet assembly 42 with respect to the user 22. The jet assembly 42 is telescopically adjusted within the interior chamber 36 by pulling the jet assembly 42 forwardly toward the tub interior in order to remove the pins 70 from the apertures 72. Once the desired height is attained the pins 70 can be repositioned within a different set of apertures 72. The spring-biased pins 68 will bias the entire assembly 42 rearwardly for insertion of the pins 70.

With the jet assembly 42 properly positioned, the user 22 can now sit or stand in the tub 10 with the specific body part pressed against the diaphragm 54 to enjoy the soothing benefits of the dry hydro-massage. Once the unit 30 is turned on, a mixture of turbulent air and water is discharged from the jet 44 against the interior of the diaphragm 54. The soothing action of the turbulent fluid will be felt through the diaphragm 54. As the water bounces off the diaphragm it flows through the circular opening 76, downwardly through the water vent passage 60 and into the tub basin through the exhaust port 40. Trapped air is vented through the top air vent 58. As a result the user 22 can enjoy the therapeutic benefits of a hydro-massage without the annoying splash associated with past known assemblies which must discharge the fluid into the tub. Moreover, the present invention allows selective telescopic positioning according to different users or different body parts to be massaged.

Following use, the hydro-massage jet assembly 42 can be stored within the chamber 36 by telescopically lowering the assembly 42. In this position, the top of the assembly 42 will be even with or below the top rim 24 of the tub 10 while the diaphragm covered discharge jet will be nested within the slot 38 of the enclosure wall 34. A tub cover can now be placed over the tub basin 10 to insulate the tub 10 and prevent the heat of the water from quickly dissipating. Since in cold climate areas the tub cover is important to maintain the energy efficiency of the tub 10, standard covers will only fit over the tub if the dry hydro-massage unit can be lowered to a position substantially flush with the top rim of the tub.

As alternative embodiments of the present invention, the dry hydro-massage unit may be fixedly positioned above the top rim of the tub whereby a specially configured cover will be needed. The hydro-massage unit may also be pivotable or rotatable to vary the angle of the diaphragm covered massaging unit according to particular requirements. Finally, a headrest may be provided to steady the user's head while the back of the neck is massaged. The headrest may be in the form of an extension of the housing or a separate pillow-like attachment to the top of the housing which allow the user to tilt the head back to fully enjoy the therapeutic benefits of the dry hydro-massage.

The foregoing detailed description has been given for clearness of understanding only and no unnecessary limitations should be understood therefrom as some modifications will be obvious to those skilled in the art without departing from the scope and spirit of the appended claims:

I claim:

1. A dry hydro-massaging unit for mounting in a peripheral wall of a spa tub having a top rim, said dry hydro-massaging unit comprising:

a hydro-massage jet assembly having a discharge jet and means for movably mounting, said hydro-massage jet assembly within the peripheral wall of the spa tub;

means connected to said hydro-massage jet assembly for supplying a massaging fluid to said discharge jet; and a diaphragm sealingly covering said discharge jet whereby said massaging fluid from said discharge jet massagingly flexes said diaphragm;

said means for mounting said hydro-massage jet assembly allows said assembly to be movable within the peripheral wall of the spa tub such that said diaphragm covered discharge jet is selectively movable between a first position below the top rim of the spa tub and second position above the top rim of the spa tub.

2. The dry hydro-massaging unit as defined in claim 1 wherein the peripheral wall of the spa tub includes an opening for receiving said hydro-massage jet assembly, said unit further comprising an enclosure wall adapted to cover the opening in the tub wall and form an interior chamber open to the top of the tub, said means mounting said hydro-massage jet assembly allows said assembly to be slidably disposed within said chamber, said enclosure wall adapted to be mounted substantially flush with the peripheral wall of the spa tub.

3. The dry hydro-massaging unit as defined in claim 2 wherein said enclosure wall includes an elongated slot defining an opening for receiving, said diaphragm covered discharge jet and an exhaust port adapted to be disposed below the water line in the tub, said exhaust port adapted to provide fluid communication between said interior chamber and the interior of the spa tub.

4. The dry hydro-massaging unit as defined in claim 3 wherein said hydro-massage jet assembly includes air venting means and water venting means, said water venting means communicating with said interior chamber such that water from said discharge jet is vented into said interior chamber and into the spa tub through said exhaust port in said enclosure wall.

5. The dry hydro-massaging unit as defined in claim 3 and further comprising guide tracks mounted to said enclosure wall on opposite sides of the opening of said elongated slot, said guide tracks movably receiving said hydro-massage jet assembly.

6. The dry hydro-massaging unit as defined in claim 5 wherein said hydro-massage jet assembly includes lock means engageable with said guide tracks to selectively position said jet assembly along said guide tracks and selectively lock said jet assembly between said first and second positions.

7. The dry hydro-massaging unit as defined in claim 1 wherein said discharge jet is a pulsating discharge jet providing a pulsating massaging fluid against said diaphragm.

8. The dry hydro-massaging unit as defined in claim 1 wherein said discharge jet is a rotating discharge jet providing massaging fluid against said diaphragm in a circular motion.

9. The dry hydro-massaging unit as defined in claim 1 wherein said discharge jet is a reciprocating discharge jet providing massaging fluid against said diaphragm in a reciprocating motion.

10. A dry hydro-massaging unit for mounting in a peripheral wall of a spa tub, the tub wall including an opening for receiving said unit, said dry hydro-massaging unit comprising:

an enclosure wall adapted to cover the opening in the tub wall, said enclosure wall adapted to form an interior chamber open to the top of the tub;

a hydro-massage jet assembly having a discharge jet, said hydro-massage jet assembly having means adapted to slidably mount said assembly within said chamber;

means connected to said hydro-massage jet assembly for supplying a massaging fluid to said discharge jet; and a diaphragm sealingly covering said discharge jet whereby said massaging fluid from said discharge jet massagingly flexes said diaphragm while fluid flow past said diaphragm is prevented;

said means mounting said hydro-massage jet assembly allows said assembly to be selectively telescopingly movable within said interior chamber between a first position substantially level with the water line in the spa tub and a second position above the top rim of the spa tub.

11. The dry hydro-massaging unit as defined in claim 10 wherein said enclosure wall includes an elongated slot defining an opening for receiving and guiding said diaphragm covered discharge jet, and an exhaust port adapted to be disposed below the water line in the tub, said exhaust port adapted to provide fluid communication between said interior chamber and the interior of the spa tub.

12. The dry hydro-massaging unit as defined in claim 11 wherein said discharge jet comprises a venturi jet for providing a massaging fluid of air-entrained water against said diaphragm.

13. The dry hydro-massaging unit as defined in claim 12 wherein said hydro-massage jet assembly includes means for venting air from said discharge jet through the top of said hydro-massage jet assembly.

14. The dry hydro-massaging unit as defined in claim 13 wherein said hydro-massage jet assembly includes means for venting water from said discharge jet into said interior chamber such that water from said discharge jet is vented into said interior chamber and into the spa tub through said exhaust port in said enclosure wall.

15. The dry hydro-massaging unit as defined in claim 11 wherein said enclosure wall includes a pair of parallel guide tracks mounted on opposite sides of the opening of said elongated slot, said tracks guidingly receiving said hydro-massage jet assembly for telescoping movement therealong.

16. The dry hydro-massage unit as defined in claim 15 wherein said hydro-massage jet assembly includes lock means, engageable with said guide tracks to selectively position said jet assembly along said guide tracks.

17. The dry hydro-massage unit as defined in claim 16 wherein said lock means comprises pin means selectively engageable with a plurality of aligned apertures in said guide tracks.

18. The dry hydro-massage unit as defined in claim 1 wherein said means for supplying a massaging fluid to said discharge jet includes flexible hoses connected between said hydro-massage jet assembly and the tub wall.

19. In a spa tub having a top rim, a bottom and peripheral wall defining a tub interior for holding water having a water line below the top rim, a dry hydro-massage unit selectively positionable against select body parts of the user both above and below the water line for providing a dry hydro-massage of the user's body parts without discharging fluid against the body part, said dry hydro-massage unit comprising:

a hydro-massage jet assembly having a discharge jet said hydro-massage jet assembly having means adapted to telescopically mount said assembly within the peripheral wall of the spa tub for movement between a first position and a second position;

means connected to said hydro-massage jet assembly for supplying a massaging fluid to said discharge jet; and a diaphragm sealingly covering said discharge jet whereby said massaging fluid from said discharge jet massagingly flexes said diaphragm, the user positioning said diaphragm against the select body part such that said diaphragm massagingly flexes against the user's body part.

20. The dry hydro-massage unit as defined in claim 19 wherein said means mounting said hydro-massage jet assembly with said diaphragm covered discharge jet allow said assembly to be selectively movable between a first position substantially even with the water line in the spa tub and a second position above the top rim of the spa tub.

21. A dry hydro-massaging unit for mounting in a peripheral wall of a spa tub having a top rim, said dry hydro-massaging unit comprising:

a hydro-massage jet assembly having a discharge jet, means for mounting said hydro-massage jet assembly within the peripheral wall of the spa tub;

means connected to said hydro-massage jet assembly for supplying a massaging fluid to said discharge jet; and a diaphragm sealingly covering said discharge jet whereby said massaging fluid from said discharge jet massagingly flexes said diaphragm while fluid flow through said diaphragm is prevented, said massaging fluid discharging from said hydro-massage jet assembly through auxiliary vent means;

said means mounting said hydro-massage jet assembly with said diaphragm discharge jet allow said assembly to be positionable above the top rim of the spa tub.

22. The dry hydro-massaging unit as defined in claim 21 wherein said means mounting said hydro-message jet assembly with said diaphragm covered discharge jet allows said assembly to be selectively movable between a first position substantially level with the water line in the spa tub and a second position above the top rim of the spa tub.

* * * * *